United States Patent [19]

Brunn

[11] Patent Number: 4,565,420

[45] Date of Patent: Jan. 21, 1986

[54] SOCKET AND BASE FOR PICTURE TUBES

[75] Inventor: Otto Brunn, Wernau, Fed. Rep. of Germany

[73] Assignee: International Standard Electric Corporation, New York, N.Y.

[21] Appl. No.: 543,180

[22] Filed: Oct. 19, 1983

[30] Foreign Application Priority Data

Oct. 27, 1982 [DE] Fed. Rep. of Germany ..... 3239691

[51] Int. Cl.[4] ..... H01R 13/53

[52] U.S. Cl. ..... 339/193 P; 339/143 T

[58] Field of Search ..... 339/14 T, 111, 143 R, 339/143 T, 145 T, 193 R, 193 P, 193 S, 193 N, 193 VS

[56] References Cited

U.S. PATENT DOCUMENTS 3,979,157 9/1976 DiMattio ..... 339/145 T

*Primary Examiner*—Neil Abrams

*Attorney, Agent, or Firm*—James B. Raden; William J. Michals

[57] ABSTRACT

A novel space-saving socket and base assembly for high-voltage picture tubes is disclosed. The inventive socket, which does not project over the base in the direction of the longitudinal axis of the picture tube, is obtained by optimizing the air and creepage paths of the socket and base through the use of an aperture positioned in the base for locating the high-voltage lead. This effectively reduces the overall length requirements for mounting these tubes inside equipment housings, and the size of these housings thereby.

7 Claims, 4 Drawing Figures

SOCKET AND BASE FOR PICTURE TUBES

The invention relates to a socket and a base of the type as set forth in the preamble of the claim.

For picture tubes operating at high focusing voltages, it is known to use bases in which the focusing voltage pin is arranged in a chamber or hollow body structure, i.e. the so-called "silo". In such a conventional type of base a high-voltage plug with an insulation filling out the interior of the hollow body structure, serves as the high-voltage lead from the power supply unit. Such a high voltage plug may also be combined with the further plugs of the socket to form one structural unit. In that case, the one half of the base or of the socket is provided for this particular high voltage terminal whereas all other terminals are arranged on the other half of the base. In this way it is possible to provide sufficiently dimensioned air paths and creepage paths between the leads, which in size exceed the protective gap. In one base as known from DE-OS No. 27 18 966 the hollow body structure is almost as long as the base.

Accordingly, the socket or the additional high voltage connector must project over the base in the direction of its longitudinal extension parallel in relation to the axis of the picture tube. This, however, is of a disadvantage in so far as the mounting size of the picture tube is still enlarged beyond the base. In order to be able to keep the depth of the equipment in which the picture tube is to be installed, as small as possible, the socket must be prevented from protruding over the base. The form of construction of the conventional bases is to be maintained as far as possible.

It is the object of the invention to further develop the hitherto well-proven form of construction in such a way as to prevent the socket from protruding over the base.

According to the invention, this object is achieved by the combination of features set forth hereinbelow.

The novel base differs from the conventional base in that a slot in the outer wall of the base which extends from one edge of the hollow body structure parallel in relation to the axis of the base, opens the hollow body structure throughout 30—60% of its length. Into this slot, during placement of the socket, there is inserted a lead-in conductor extending to the high-voltage terminal, which then extends from the connecting spring on the inside, radially towards the outside. By this way of leading out the high-voltage lead towards the side, the length of the socket can be kept so small that it, including the dimension necessary for the terminals of all leads, is still shorter than the base itself. There are various ways of embodying the terminals, quite depending on whether the leads are printed conductors or cables. All types of leads, however, are required to maintain the air and creepage paths provided for with respect to both the base and the socket. The fact that, according to the invention, the leads are led out on one side of a short socket provides a good condition to this end.

The invention will now be described with reference to FIGS. 1 to 4 of the accompanying drawings, in which.

Figure 1:
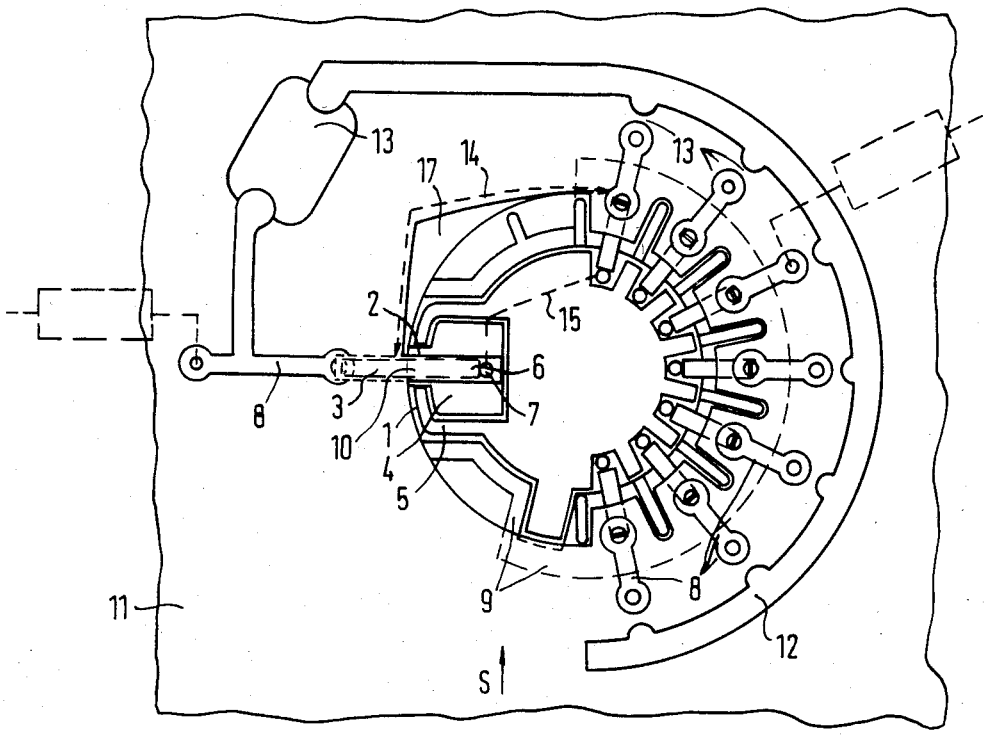
FIG. 1 is a bottom view of the base, with the socket inserted.

FIG. 1 shows the base 5 as seen from the bottom (rear) side of the picture tube with the socket 9, 10 inserted and with the board 11 designed as a printed circit board comprising the connecting line conductors 8. The ground connection is indicated by the reference numeral 12 and the protective gaps are indicated by the reference numeral 13. The chamber or hollow body structure (silo) 4 comprises a slot 2 through which the lead 3 extending to the connecting spring 6, establishing the contact with the contact pin 7, is guided. Although it is beneficial not to have slot 2 extend the entire length of base 5, it has been found that it is easier to assemble base 5 and socket 9, 10 when slot 2 is between 30 and 60% of the length of base 5. further, it has been found to be particularly easy to assemble base 5 and socket 9, 10 when high voltage lead 3 is located, when assembled, in the middle third of base 5. The cutout portion 17 in the bottom part 10 of the socket can be enlarged so that the creepage path 14 is greater than the one also existing with the conventional types of combinations of base and socket, i.e. than the smallest creepage path 15 existing on the base.

Figure 2:
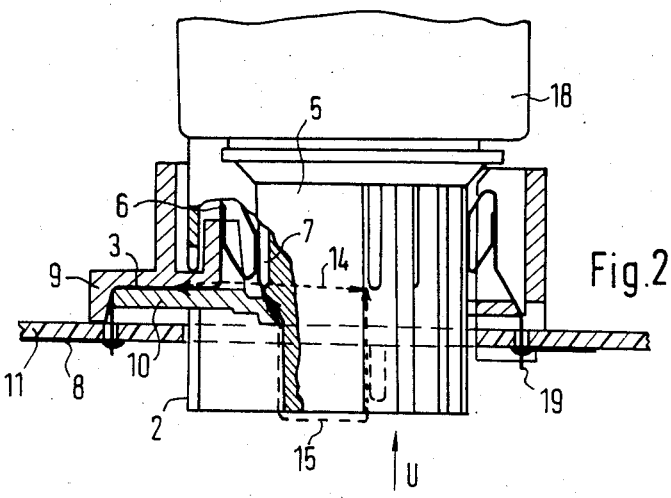
FIG. 2 is a side view of the base in a partly sectional view with the socket inserted.

FIG. 2 shows the embodiment of FIG. 1 as seen in the direction indicated by the arrow S. From this drawing it can be seen how the lead 3 is led through the slot 2 between the jacket part 9 and the bottom part 10 of the socket, toward the outside.

The neck 18 of the picture tube carries the base 5. A sealing compound between the neck of the picture tube and the base prevents the development of air and creepage paths. Between the jacket part 9 and the bottom part 10 of the socket, the lead 3 extends in the radial direction through the slot 2 laterally towards the outside. The lead 3 is arranged in the middle third of the length of the base.

Figure 3:
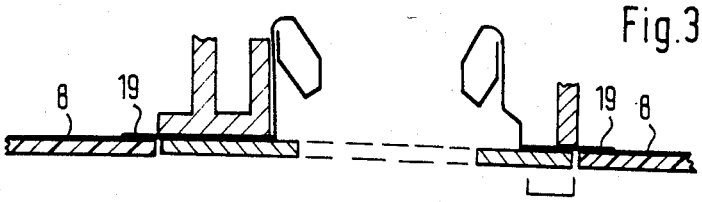
FIG. 3 is a cut-away side view of both the socket and the p.c. board in an alternate preferred.

Another preferred space-saving embodiment is shown in FIG. 3. The terminals 19 of the leads are led out horizontally and connected to the conductors 8 arranged on the top side of the p.c. board.

Figure 4:
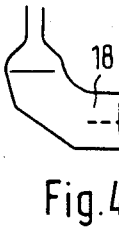
FIG. 4 is a cut-away side detail of the socket of FIG. 2.

FIG. 4 shows that the arrangement according to the invention of both the base and the socket does not absolutely require the connections to be made with the aid of a board 11 designed as a printed circuit board. In this example of embodiment, the electrical connections are established with the aid of one or more connectors 8 on the circumference of the jacket and bottom parts 9, 10 of the socket connected in a flange-like manner.

The creepage path 15 extends from the contact pin 7 to the next one of the other contact pins along the surface of the base, as indicated by the dashlines in FIGS. 1 and 2. The length of the base 5 is so dimensioned, and the contact pins are arranged in niches, such that creeping currents are prevented from developing. A creepage path 14 dimensionally corresponding to the creeping path 15, and extending on the socket, extends along the bottom part 10 of the socket and is indicated by the dotted line in FIGS. 1 and 2. When the same surface quality of materials is used for both the socket and the base with respect to the creeping-current resistance, the critical creepage path 14 on the socket does not need to be longer than the creepage path 15 which is decisive for the base. The invention discloses an arrangement in which, by avoiding an excessively long creepage path 14, a shorter socket is realized in that the hollow body structure of the base is partially opened towards the outside. This provides favorable constructional possibilities for embodying a space-saving socket of which three examples of embodiment are shown in FIGS. 2 to 4. Thus it is seen how novel space-saving sockets can be fashioned which are shorter than their corresponding bases by as much as 20 to 40%. It is of particular advantage to design terminals 19 of the leads extending to the connecting springs 6 in such a way that they can be bent from the radial direction into the axial direction, or vice versa. A socket consisting of the jacket part 9 and of the bottom part 10 may then be easily adapted to various types of p.c. boards, connectors, etc. Instead of the two-part design of both the jacket and the bottom part, both may also be designed as one part, in which case the p.c. board may likewise be integrated.

I claim:

1. A high voltage socket and base assembly for a picture tube having longitudinally downwardly extending pins comprising:

a hollow base having an outer wall, said outer wall defining a plurality of longitudinally extending channels for reception of said pins, one of said channels forming a silo, and a throughgoing open slot formed in a portion of said silo, said slot leading to said silo;

said socket having a single high-voltage lead for engagement with one of the pins of the picture tube, said high-voltage lead having a portion radially extending through said slot and into said silo, the radially extending portion of said high-voltage lead being enclosed by insulative portions of said socket;

said slot being sized to provide insertion of the radially extending lead enclosed by said insulative portion of said socket, and said socket having a line conductor electrically connected to said high-voltage lead.

2. The high-voltage socket and base assembly of claim 1 wherein said open slot is located towards the bottom of said silo.

3. The high-voltage socket and base assembly of claim 2 wherein said slot extends throughout 30%—60% of the length of said outer wall section.

4. The high-voltage socket and base assembly of claim 1 wherein said high-voltage lead further includes an electrically conductive connecting spring, said spring providing said electrical connection from said high-voltage lead to said socket.

5. The high-voltage socket and base assembly of claim 1 wherein the radial portion of said high-voltage lead is located in the middle third of the length of said base.

6. The high-voltage socket and base assembly of claim 1 wherein said socket is 20%–40% smaller in length than said base.

7. The high-voltage socket and base assembly of claim 1 further including a plurality of socket electrical connections, each of said electrical connections extending longitudinally within said base.

* * * * *